US005892212A

United States Patent [19]

Rentsch

[11] Patent Number: 5,892,212

[45] Date of Patent: Apr. 6, 1999

[54] NOMOGRAPHIC COMPUTING DEVICE

[76] Inventor: Frederic Rentsch, Augustinergasse 44, 8001 Zuerich, Switzerland

[21] Appl. No.: 17,179

[22] Filed: Feb. 2, 1998

[51] Int. Cl.[6] ..... G06C 15/00

[52] U.S. Cl. ..... 235/419; 235/70; 235/61; 33/97

[58] Field of Search ..... 235/70, 61; 33/97

[56] References Cited

U.S. PATENT DOCUMENTS

| | | | |
|---|---|---|---|
| 754,086 | 3/1904 | Nichols | 33/97 |
| 2,138,879 | 11/1938 | Poole | 235/70 |
| 2,300,401 | 11/1942 | Basler et al. | 33/97 |
| 3,339,838 | 9/1967 | Skuderna | 235/61 |
| 3,568,922 | 3/1971 | Pepper | 235/70 |
| 3,766,652 | 10/1973 | Gomez | 33/97 |
| 3,837,569 | 9/1974 | Bradbury et al. | 235/70 |

*Primary Examiner*—Anita Pellman Gross
*Assistant Examiner*—Daniel S Felten
*Attorney, Agent, or Firm*—Walter C. Farley

[57] ABSTRACT

A nomographic apparatus for providing solutions to a mathematical relationship has a panel and several scales along three axes on a surface of the panel, the scales being arranged and calibrated in a nomographic relationship so that values on a straight line intersecting the scales satisfy the mathematical relationship. Guides are adjacent two selected ones of the scales, the two selected scales being separated by at least one other scale. First and second sliders are movable along the guides and strings extend between the sliders in substantially straight lines. The first and second sliders are positionable so that the strings intersect first and second locations on the selected scales, the locations representing selected numerical values of the mathematical relationship. As a result, a third value of the mathematical relationship is readable adjacent the other of the scales.

1 Claim, 3 Drawing Sheets

FIG. 1
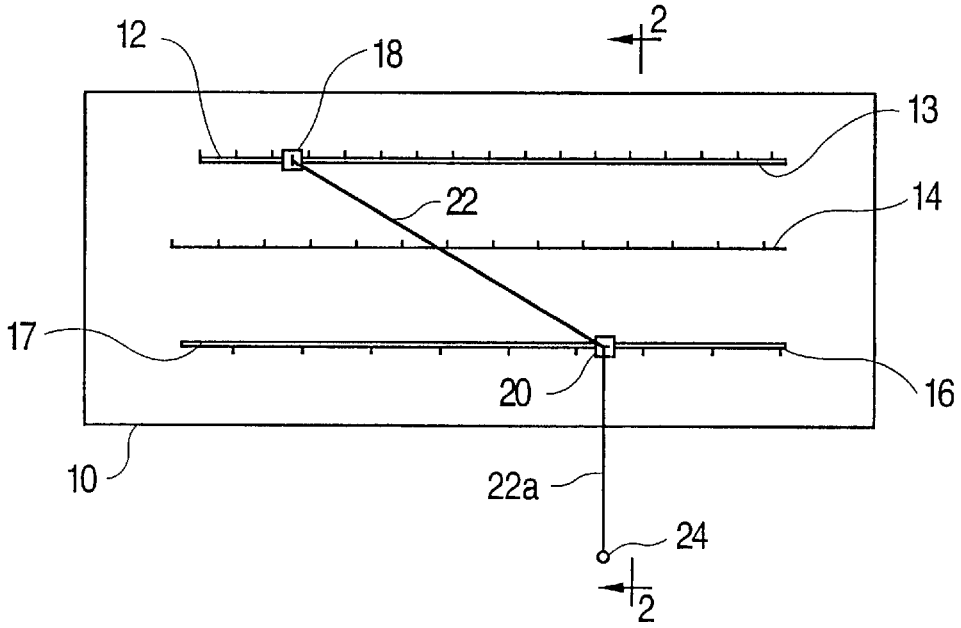
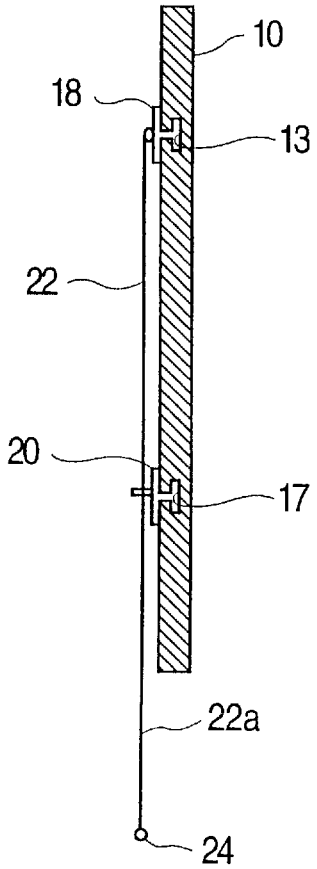
FIG. 2

NOMOGRAPHIC COMPUTING DEVICE

FIELD OF THE INVENTION

This invention relates to nomograms and more particularly to a nomographic computing device and a method for making same.

BACKGROUND OF THE INVENTION

A nomogram is a graphic computing device defined as three numeric axes dimensioned and arranged in such a way that an arbitrary straight line will intersect the axes at values that are correlated by some specific mathematical function. In other words, the three axes are the loci of three variables that are correlated by some specific mathematical function so that three points on the lines which simultaneously satisfy the function form a straight line when connected.

Nomograms are capable of reducing the dimensionality of a solution space. Given, for example, two axes representing, respectively, numerators (n) and denominators (d) of a division (n/d), the solution space of the division can be said to be two-dimensional, since each value on each axis combines with each value on the other axis. If the axes are arranged as Cartesian coordinates, the locus of all solutions is the entire area of the coordinate system. The locus of equivalent solutions is a straight line starting at the origin. If the two axes are arranged nomographically, however, the locus of equivalent solutions collapses from a straight line to a point and the locus of all solutions collapses from an area to a line. This line is the third axis of the nomogram.

Solving two determined values for a third dependent value by means of a nomogram consists in drawing a straight line through the two determined values, each on its own axis, and reading the dependent value off the third axis where the straight line intersects. This property has two practical advantages. The first one is that a nomographic solution presents a picture whose interpretation requires far less abstract intelligence than the interpretation of an arithmetic or tabular solution: the numbers and their interdependence are intuitively comprehensible from the picture. The second advantage is that the function solves in all directions with equal ease, no matter which of the three variables is the unknown that depends on the other two.

The two advantages combine to render nomograms particularly useful for finding solutions, not so much for two predetermined values as for functional sets of undetermined values that should conform to certain incidental requirements. Mathematically intractable dependencies of this kind occur often in practical engineering. They must be solved by iterative experimentation. Iterative experimentation by means of a nomogram amounts to shifting a ruler around and assessing the quality of the values at three intersections in terms of the design objective, a fairly straightforward approach that is also expedient on account of the fact that the scales suggest which way the ruler should be moved to improve an unsatisfactory position.

SUMMARY OF THE INVENTION

Briefly described, the invention comprises a nomographic apparatus for providing a plurality of solutions to a mathematical relationship comprising a panel with indicia defining a plurality of scales along three axes on a surface of the panel, the scales being arranged and calibrated in a nomographic relationship whereby associated values of said scales satisfy said mathematical relationship. Guides are adjacent two selected ones of the scales, the two selected scales being separated by another of the scales. First and second sliders are movable along the guides and positionable adjacent first and second locations, respectively, on the two selected scales, the locations representing selected numerical values of the mathematical relationship. A string element extends between the sliders in a substantially straight line, whereby a third value of the mathematical relationship is readable adjacent the other scale.

BRIEF DESCRIPTION OF THE DRAWINGS

In order to impart full understanding of the manner in which these and other objects are attained in accordance with the invention, particularly advantageous embodiments thereof will be described with reference to the following drawings, which form a part of this disclosure, and wherein:

FIG. 1 is a front elevation of a device in accordance with the invention;

FIG. 2 is an end elevation, in section and at an enlarged scale, of the device of FIG. 1;

DESCRIPTION OF THE PREFERRED EMBODIMENTS

Figure 3:
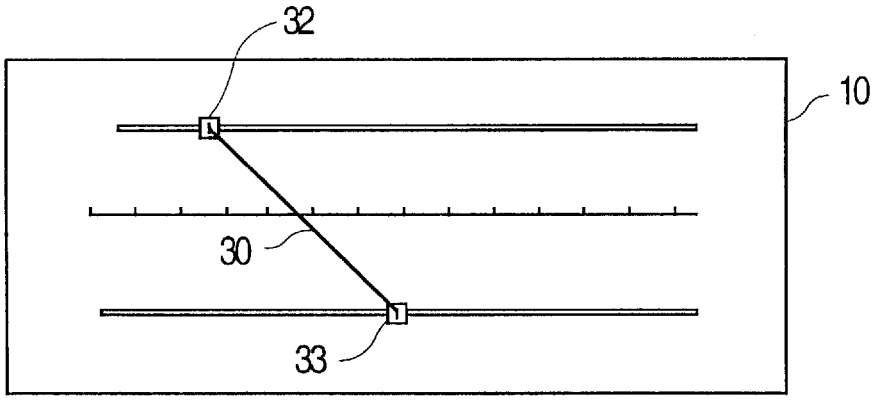
FIG. 3 is a front elevation of a further embodiment of an apparatus in accordance with the invention.

The invention provides a nomographic computing device, and a method of constructing a nomographic computing device. As shown in FIGS. 1 and 2, a simplified device includes a panel 10 on which three nomographic axes 12, 14 and 16 are arranged and numerically graduated with appropriate indicia. The graduations can represent any form of scale suitable to the problem being solved and can, in general, be linear, logarithmic or otherwise as dictated, in a generalized sense, by mathematical consistency with the mathematical relationships of the problem being solved. Coinciding with the two outermost axes 12 and 16, are linear tracks 13 and 17, akin to curtain rails, along which sliders 18 and 20 can be moved and arrested. A slider on one track is interconnected with a slider on the other track by means of a flexible string 22 sufficiently tensioned to form a straight line so that the string intersects the third axis and its scale resolves the modeled function for the two values on which the interconnected sliders are set along their respective axes.

In this context, it should be recognized that the term "axis" is used to mean a line extending along the surface of a panel or the like, and the term "scale" is used to mean one or more sets of calibrations along an axis. In a nomogram, there are three axes only, although any axis may have more than one scale associated with it. While there are "alignment charts" using nomogram principles and having more than three axes, these are actually combinations of two or more nomograms assembled on the same surface for convenience in calculating a sequence of solutions.

Two tensioning mechanisms are disclosed. In the embodiment of FIGS. 1 and 2, a small weight 24 at the end of string 22 exerts a force on the string which maintains its linearity. This embodiment requires that the panel be fixed during use in a vertical plane, normally hung on a wall. The upper end of string 22 is tied to top slider 18. Bottom slider 20 has an eyelet or the like through which the string is threaded so as to be held laterally while remaining free to move vertically. A length of string 22*a* hangs down below the panel. Weight 24 is attached to its lower end.

The other tensioning mechanism uses the elasticity of a spring or a rubber band. In its simplest version as shown in FIG. 3, an elongated elastic body such as a rubber band 30 interconnects a pair of sliders 32 and 33, opposite ends of the rubber band being fixedly attached to the sliders. The rubber band can be replaced by an equivalent arrangement comprising a minimally elastic string and an extension spring, in series between the two sliders.

Figure 4:
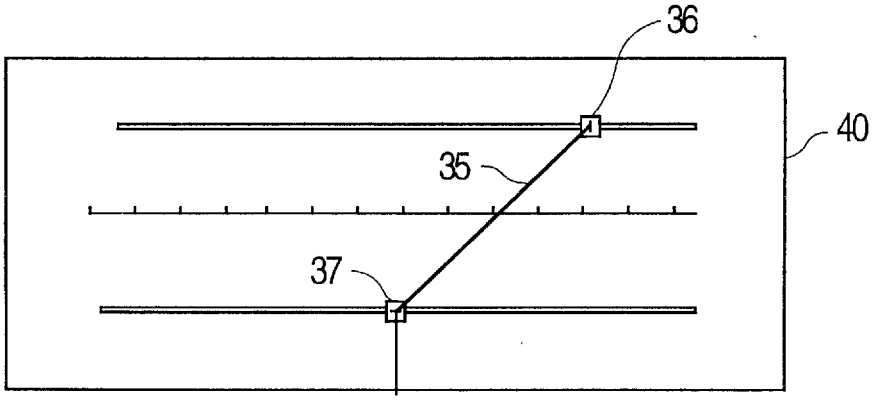
FIG. 4 is a front elevation of another embodiment in accordance with the invention.
Figure 5:
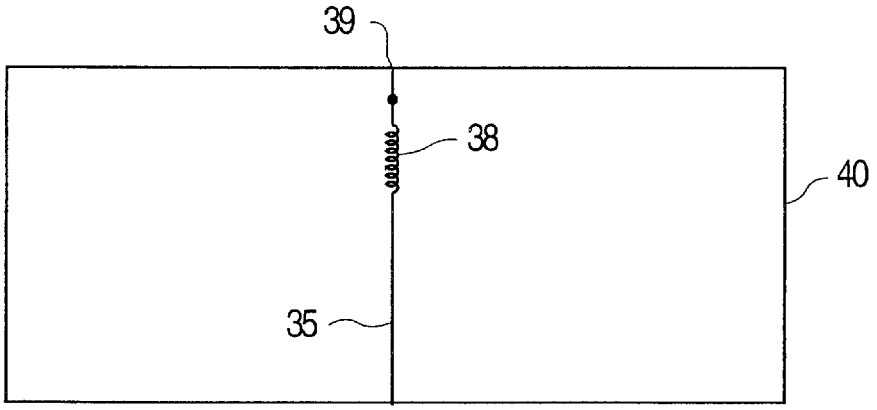
FIG. 5 is a rear elevation of the embodiment of FIG. 4.

A slightly more complex arrangement is shown in FIGS. 4 and 5 wherein a substantially inelastic string or the like 35 is connected at one end to a slider 36 mounted in a track on a panel 40 and passes through an eyelet 37 through which the string can move freely, as in the embodiment of FIGS. 1 and 2. The other end of the string is connected to one end of an extension spring 38 (FIG. 5) the other end of which is attached to a fixed point 39 on the supporting panel 40. In the embodiment shown, the spring is on the back of the panel so that the string passes around an edge thereof, but this is merely a space-saving feature and is by no means essential.

This basic configuration can be elaborated in various ways. Function matrices can be modeled by using multiple sliders on both tracks and interconnecting each slider with each slider on the opposite track. Where logarithmic scales are consistent with the nomographic functionality, they can be put on slides that shift in the direction of their axes and factor up or down, slide rule style. This construction can be particularly appropriate for the central axis which the strings intersect.

A specific solution to a practical engineering problem is the optimization of a derailleur type bicycle transmission which is chosen as a practical example illustrating the invention. It is characteristic of this task that the design parameters do not derive from the design objective in a way that is mathematically determinable.

The design objective is to produce a set of gears having a reasonably even distribution of transmission ratios, sufficiently closely spaced to provide smooth shifting transitions, covering a predetermined range. The determination of what is "sufficiently closely spaced" is left to the human designer using the nomographic computer and is made on the basis of factors such as the practical availability of various sprockets and the effect of ratio changes, meaning that the gear ratio changes should not be too small to be meaningful nor too large to break the continuity of the sequence.

The design parameters are the sizes of bicycle sprockets assembled in two sets: a driving set at the pedal crank and a driven set at the hub. Each sprocket of each set combines with each sprocket of the other set to produce some transmission ratio: crank sprocket size divided by hub sprocket size. This dependency can be positively formulated. Yet, while two sprockets determine a transmission ratio, the reverse is not the case: a transmission ratio does not determine the size of two sprockets, only their relative size. Realizing a desired transmission ratio, then, is an experimental process of figuring the ratios between available sprockets and of deciding whether a ratio comes dose enough to the goal. The real difficulty comes from the fact that the ratios are a two-dimensional matrix, number of crank sprockets by number of hub sprockets. We cannot change a single ratio in the matrix. Each sprocket exchanged modifies an entire row or column of transmission ratios. The answer, whether or not a certain modification of an entire array of ratios will constitute an improvement, is best left to the human brain's superb pattern-processing capabilities, provided the ratio matrix is presented in a form recognizable as a pattern.

The following description is specific to the problem of creating a bicycle transmission computer and is selected as an illustrative example. The ensuing specificity, therefore, must not be interpreted as characteristic of the invention's essence. It does not delimit the invention's scope to the effect that other uses and other similar constructions would fall without.

Figure 7:
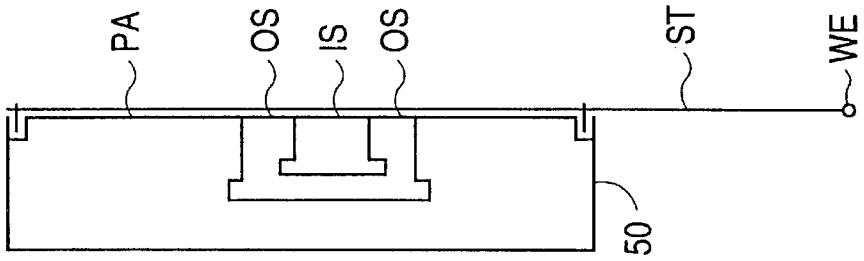
FIG. 7 is an end elevation, in section, along line 7—7 of FIG. 6.
Figure 6:
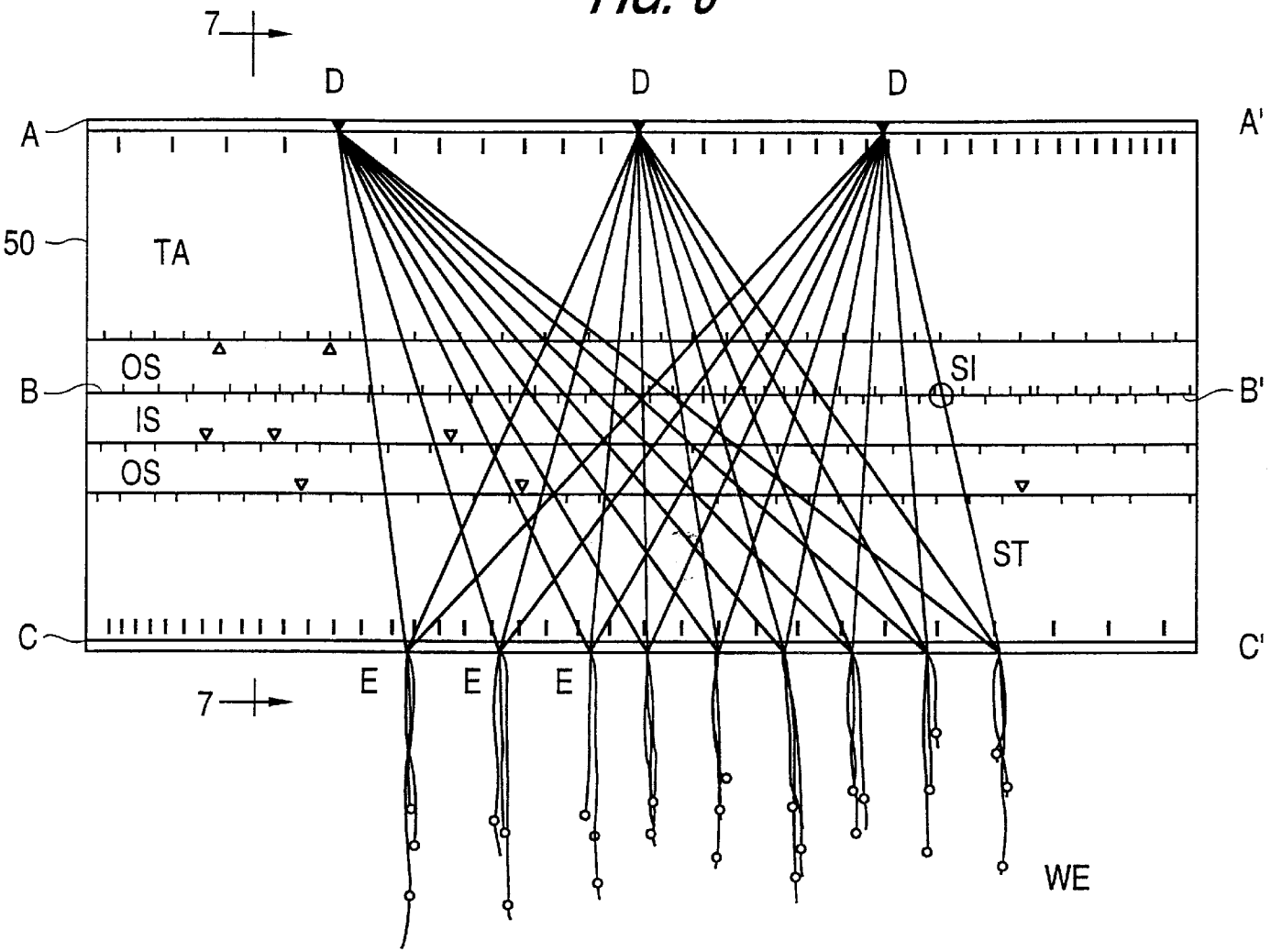
FIG. 6 is a front elevation of yet another embodiment of an apparatus in accordance with the invention.

As shown in FIGS. 6 and 7, a rectangular panel 50, meant to hang in a substantially vertical plane on a wall, has a graduated numeric axis A–A' extending along the top edge, another graduated numeric axis C–C' running along the bottom edge and a third graduated numeric axis B–B' running parallel in between the top and bottom axes. Points along the topmost axis A–A ' represent the sizes of available driving sprockets at the crank. Points along the bottommost axis C–C' represent available sizes of the driven sprockets at the hub. Axis B–B' in between represents transmission sprocket ratios.

The positioning of the axes and their scales needs to be mathematically correct. One consequence of mathematical correctness is that the sprocket scales are inverted with reference to one another, e.g., if the smallest numbers of A–A' are at the left end of the panel, the largest numbers of C–C' must be at the left end of the panel. Another consequence is that the numeric progression on all scales is logarithmic.

Two tracks are affixed respectively along the top and the bottom edges. They contain, respectively, three sliders D and nine sliders E. A string runs between each opposing slider pair, totaling twenty-seven strings. When one is modeling assemblies comprising less than three crank sprockets or less than nine hub sprockets, the unused strings are disconnected from, for example, the top sliders and allowed to hang inactively from their respective bottom sliders.

The top sliders D are set to match the sprockets of a crank assembly and the bottom sliders E are set to match the sprocket sizes of a hub assembly, with the result that a one-dimensional image of the resulting ratios emerges in the form of string intersections along the central axis B–B'. Evaluating the quality of the ratio matrix is a simple matter of visually characterizing the pattern of intersections along the ratio axis as regular or irregular. The designer instantly identifies offending sprockets at the end of offending strings. Attempting to correct an offending sprocket, he will observe the corrective motion of the offending string. Simultaneously, he observes the motion of all other strings that emanate from the slider being moved and will instantly recognize whether the attempted correction will be favorable or not in terms of the assembly's overall distribution. In this manner he can explore alternative corrections and will in a matter of a short time acquire an exhaustive understanding of all available options from which he can then pick the best one.

For the purpose of numeric analyses, a tandem slide arrangement is used. The central axis (the ratio axis) B–B' is placed on a slide OS that can be moved horizontally, i.e., longitudinally along the direction of the axis in a manner similar to a slide rule. This mechanism works because the scales are all logarithmic. The placement of the tandem slide rule with reference to the ratio axis B–B' is such that one of the two sliding joints between the outer and inner slides coincides with the axis. Two graduated scales can now be placed immediately adjacent the axis, one residing on the outer slide and the other on the inner slide. The scale on the outer slide graduates the ratio axis in gear meters, distance traveled per one crank revolution, once the outer slide has been correctly positioned with reference to the panel by means of a reference mark and a wheel-size setting scale. The scale adjacent the ratio axis on the inner slide graduates the axis in one or more of a variety of alternative formats, depending on which reference marks and setting scales are used to position the inner slide with reference to the outer slide. Some of these alternative formats are: gear feet, gear inches and speed for a given cadence (crank RPM).

What is claimed is:

1. A nomographic apparatus for providing a plurality of solutions to a mathematical relationship comprising a panel;

indicia defining a plurality of scales along three axes on a surface of said panel, said scales being arranged and calibrated in a nomographic relationship whereby values on a straight line intersecting said scales satisfy said mathematical relationship;

means defining guides adjacent two selected ones of said scales, said two selected scales being separated by at least one other of said scales;

first and second sliders movable along said guides; and string means extending between said sliders in a substantially straight line;

said first and second sliders being positionable so that said string means intersects first and second locations, respectively, on said two selected scales, said locations representing selected numerical values of said mathematical relationship, whereby a third value of said mathematical relationship is readable adjacent said at least one other of said scales.

* * * * *